United States Patent [19]

Invernizzi

[11] Patent Number: 4,509,092

[45] Date of Patent: Apr. 2, 1985

[54] LOCK AND RELATED KEY OF ELECTRONIC TYPE

[75] Inventor: Antonino Invernizzi, Milan, Italy

[73] Assignee: Alfredo Scagliotti, Cogne, Italy; a part interest

[21] Appl. No.: 433,101

[22] Filed: Oct. 6, 1982

[30] Foreign Application Priority Data

Oct. 13, 1981 [IT] Italy ..... 24467 A/81

[51] Int. Cl.[3] ..... H01H 47/22

[52] U.S. Cl. ..... 361/172; 340/505; 340/542; 340/825.54

[58] Field of Search ..... 361/171, 172; 340/505, 340/542, 825.54; 307/10 R, 10 AT; 70/277, 278

[56] References Cited

U.S. PATENT DOCUMENTS

| | | | |
|---|---|---|---|
| 3,859,634 | 1/1975 | Perron et al. | 340/149 |
| 4,189,712 | 2/1980 | Lemelson | 340/542 X |
| 4,280,118 | 7/1981 | Brunken et al. | 361/171 X |

FOREIGN PATENT DOCUMENTS

| | | | |
|---|---|---|---|
| 0028965 | 5/1981 | European Pat. Off. . | |
| 2024914 | 1/1980 | United Kingdom | 70/277 |

*Primary Examiner*—Reinhard J. Eisenzopf

*Attorney, Agent, or Firm*—Schwartz, Jeffery, Schwaab, Mack, Blumenthal & Koch

[57] ABSTRACT

The invention concerns a lock and related key of the electronic type, which bases the unlocking of the lock on the matching of codes memorized in the lock and in the key, making it possible for one key to unlock a considerable number of pre-selected locks.

7 Claims, 1 Drawing Figure

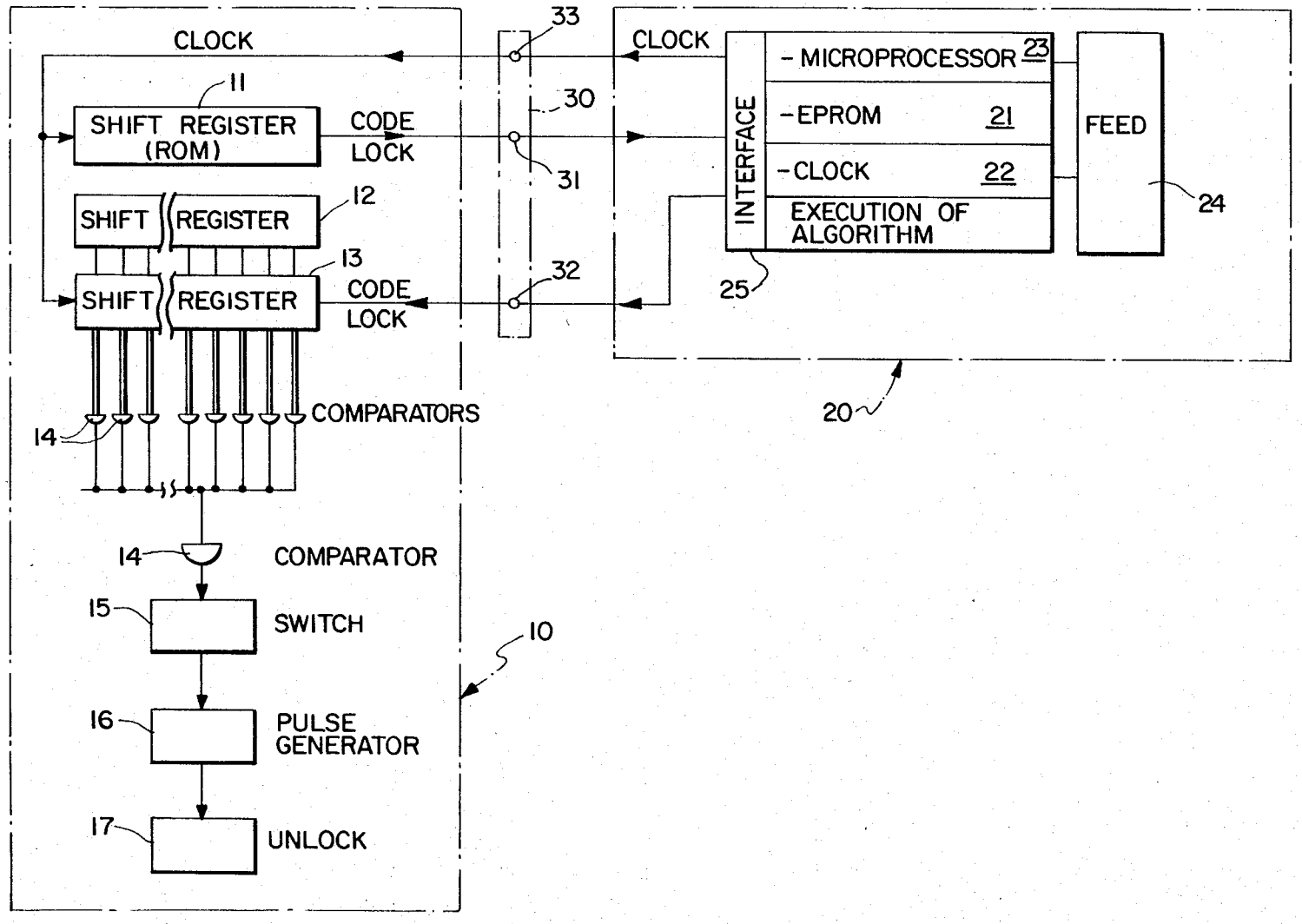
FEED
24
- MICROPROCESSOR 23
- EPROM 21
- CLOCK 22
EXECUTION OF ALGORITHM
INTERFACE
25
20
CLOCK
33
30
31
32
10
CLOCK
SHIFT REGISTER (ROM)
11
CODE LOCK
REGISTER
12
SHIFT
REGISTER
13
SHIFT
CODE LOCK
COMPARATORS
14
COMPARATOR
14
SWITCH
15
PULSE GENERATOR
16
UNLOCK
17

LOCK AND RELATED KEY OF ELECTRONIC TYPE

BACKGROUND OF THE INVENTION

The present invention relates to a high security locking system which includes keys for unlocking locks, which keys and locks can be matched in a plurality of combinations. Thus a key can be made suitable for unlocking a predetermined number of locks.

The security of the lock, moreover, depends on the number of different combinations of key identification elements which are compared by the lock by an identifier internal thereto.

The locks normally used at the present time are of the mechanical type in which a key corresponds in a reciprocally matching manner to a lock which is unlocked by it.

In particular instances, mechanical keys exist which will open several locks belonging to a relatively small group.

Clearly, in such case, the locks have to be sensitive to only a fraction of the elements to be identified (notches, holes or the like) formed in the key.

The number of such elements which can be formed on a small key is already relatively slight, and in the final analysis the lock will feature elements sensitive to the key configuration in an only fractional number: the combinations obtainable will thus be few.

It is on the other hand known that, to multiply the elements of identification of a lock, the dimensions of each such element must be reduced so as to keep the dimensions of the key within acceptable limits.

This miniaturization of parts makes the manufacture of the lock and keys more complex and the articles themselves more intricate to use.

SUMMARY OF THE INVENTION

The purpose of the present invention is to provide a lock capable of a very large number of combinations, in theory even larger than the foreseeable lock production volume, so that each of such combinations will be unique.

Moreover, according to the invention, the key can be so embodied as to unlock one or more of the locks, with unlimited choice.

This is achieved according to the invention by embodying a lock which comprises a movable locking element controlled to take up an unlockable position by an actuator operating by effect of an electric pulse, the lock also comprising a first indelible memory storing a code, a second indelible memory not accessible from the outside and containing the result of the execution of an algorithm on the code of the lock, a third, service memory adapted to receive as information a code comparable with the code stored in the second memory, means being provided for comparing the codes stored in the second and the third memory and, if they match, for piloting a switch which connects said actuator to a pulse generator, the key for said lock comprising a memory in which is stored at least one code identical to the one stored in the first memory of a lock and the related algorithm, a microprocessor and an interface of interconnection with the lock; so that, after connection of key with lock, the microprocessor compares the code stored in the first memory of the lock with the code stored in the memory of the key and, if they match, processes the code according to the same algorithm as aforesaid and relays it to the third memory of the lock.

BRIEF DESCRIPTION OF THE DRAWING

In order better to clarify the essential characteristics of the invention, an exemplifying form of a practical embodiment thereof is now described, with reference to the attached drawing which shows a block diagram thereof.

DETAILED DESCRIPTION OF THE PREFERRED EMBODIMENT

In the drawing a lock is generically indicated by 10 and the related key by 20.

The two units, key and lock, can be mated at the three terminals 31, 32 and 33 of the terminal strip 30, which terminals will therefore be mounted in a position accessible to whoever wishes to control the unlocking of the lock.

In the lock a circuit is mounted comprising a readonly indelible memory (ROM) 11 which can memorize a preestablished code consisting of an adequate number of bits and an inaccessible memory 12 in which is memorized the result of the execution of an algorithm on the code of the memory 11.

The memory 12 is connected by circuitry to a service memory 13 to enable a comparison to be made between the codes stored in the said two memories by the comparing units 14 which identify the matching of the single bits of the codes.

A positive comparison signal pilots the switch 15 to activate the pulse generator 16 to send the unlocking pulse to the unlocking mechanism 17.

This last can consist of a mechanism of electromechanical type per se known and used in locks remotely controlled by an electric signal.

The key 20 comprises a permanent memory 21 (EPROM) in which a plurality of pre-established codes each associated with an algorithm can be stored, and also comprises a clock 22 and a microprocessor 23 as well as a feed 24.

An interface 25 connects the components to the terminals 31, 32 and 33.

The functioning of the circuit described is illustrated below.

A key, in the memory 21 of which is stored at least one code with its algorithm, is connected via the terminal strip 30 to a lock 10.

In this condition the microprocessor controls the readng of the code memorized in 11 and verifies that it matches with one of the codes memorized in 21; the clock 22 is used to extract sequentially the bits of the code, which are taken off from by the terminal strip 31.

If a matching between such codes is verified, the code is processed according to the algorithm associated with that code and sent via the connection 32 to the service memory 13.

A match between the codes memorized in 12 and 13 actuates the unlocking mechanism 17, as explained heretofore.

With the circuit forming subject matter of the invention it is readily possible to multiply the combinations of the lock in a trouble-free manner; for example, if the memories are able to use binary codes of 32 binary units, more than four thousand million combinations are made available.

The element 20 constituting the key is readily miniaturized according to currently practised techniques, thus taking on wholly pocket-size dimensions.

There in fact exist on the market elements containing a microprocessor and a memory of capacity sufficient to store the codes of a certain number of locks and the instructions according to which the microprocessor reads the lock code, compares it with the codes stored in the key, processes according to an algorithm and relays the processed code to the service memory of the lock.

The feed can be contained in the lock unit or in the key unit without distinction, or in both.

A key can be made suitable for piloting the unlocking of one or more of a plurality of locks by memory-storage therein of the codes relating to each lock; the number of codes inserted can thus only find a limit in the capacity of the key memory.

The lock can be accompanied for sale purposes by a card on which the lock code and the related algorithm are memorized; with adequate means per se known, such data can be read and sent to the memory of a key to make it adapted to unlock the lock.

The key itself can be accompanied by a button strip requiring a definitive composition to enable the key to be activated; if the key is mislaid or stolen, its fraudulent use can thus be prevented.

A large number of variants can, clearly, be made to the embodiment described schematically above as exemplification.

I claim:

1. A lock system comprising:

a lock comprising:

a movable locking element having an unlocking position and a locking position;

an actuator for moving said locking element between said positions;

a first memory storing a code;

a second memory which is not externally accessible and which contains a code indicating a result of an execution of a related algorithm on said code;

a third memory adapted to receive as information a code comparable with the code stored in the second memory;

means for comparing the codes stored in the second memory and the third memory and, if they match, for causing said actuator to move said locking element to said unlocking position; and a key for said lock comprising:

a memory in which is stored at least one code identical to the code stored in the first memory, and the related algorithm;

an interface for interconnection with the lock; and a microprocessor for receiving the code stored in the first memory through said interface, comparing the code stored in the first memory with the code stored in the memory of the key and, if they match, executing a processing of the code according to the related algorithm and transmitting the result of the execution to the third memory of the lock through said interface.

2. A lock system according to claim 1, wherein said key comprises a clock for extracting bits constituting the code in the first memory according to a predetermined sequence.

3. A lock system according to claim 1, wherein said comparing means comprises first comparators for singly comparing bits contained in the second memory and in the third memory of the lock, and a second comparator for verifying the output of the first comparators for operating said actuator.

4. A lock system according to claim 1, wherein said actuator comprises an electromagnet, connected via a switch to a pulse generator.

5. A lock system according to claim 1, wherein said key comprises a card on which the code of the lock and the related algorithm are stored.

6. A lock system according to claim 5, wherein said key further comprises means for reading said card.

7. A lock system according to claim 1, wherein said key is associated with a pulse strip for feeding pre-established data to activate the circuits of the said key.

* * * * *